United States Patent [19]

Lerner

[11] 4,401,213

[45] Aug. 30, 1983

[54] CONTAINER STRIP HAVING INSERTS

[75] Inventor: Bernard Lerner, Peninsula, Ohio

[73] Assignee: Automated Packaging Systems, Inc., Twinsburg, Ohio

[21] Appl. No.: 401,880

[22] Filed: Jul. 26, 1982

Related U.S. Application Data

[63] Continuation of Ser. No. 155,399, Jun. 2, 1980, which is a continuation of Ser. No. 901,996, May 1, 1978.

[51] Int. Cl.³ ..... B65D 81/24

[52] U.S. Cl. ..... 206/205; 206/390; 206/806; 229/53; 229/55

[58] Field of Search ..... 206/205, 390, 806, 820; 229/53, 55, 69, 71

[56] References Cited

U.S. PATENT DOCUMENTS

| | | | |
|---|---|---|---|
| 1,424,356 | 8/1922 | Healy | 229/71 |
| 2,878,849 | 3/1959 | Lingenfelter et al. | 206/806 |
| 2,898,026 | 8/1959 | Aid | 206/205 |
| 3,254,828 | 6/1966 | Lerner | 229/69 |
| 3,300,120 | 1/1967 | McColgan | 229/55 |
| 3,554,435 | 1/1971 | Martinez | 229/55 |

FOREIGN PATENT DOCUMENTS

| | | | |
|---|---|---|---|
| 808470 | 3/1969 | Canada | 206/820 |

*Primary Examiner*—Stephen P. Garbe

*Attorney, Agent, or Firm*—Watts, Hoffmann, Fisher & Heinke Co.

[57] ABSTRACT

A container strip of flexible film or sheet material is disclosed having inserted elements or materials which have an effect on contents which may be disposed in a container and/or enhance the package. In one embodiment the insert has anti-corrosion properties. After corrosion-susceptible products have been sealed within the container, chemicals in the insert create a protective environment for the products. By providing inserts with other appropriate chemical constituents, other desirable effects can be created.

In an alternative embodiment, an insert can be used in a header portion of the container to provide support for display purposes.

6 Claims, 5 Drawing Figures

CONTAINER STRIP HAVING INSERTS

This is a continuation of application Ser. No. 155,399 filed June 2, 1980, which is a continuation of Ser. No. 901,996 filed May 1, 1978.

REFERENCE TO PATENTS AND APPLICATION

1. U.S. Pat. No. 3,254,468, issued June 7, 1966 to Hershey Lerner, entitled Method of Packaging Articles, here the "Airbox Patent."

2. U.S. Pat. No. 3,254,828, issued June 7, 1966 to Hershey Lerner, entitled Flexible Container Strips, here the "Container Patent."

3. U.S. Pat. No. 3,815,318, issued June 11, 1974 to Bernard Lerner, entitled Packaging Method and Apparatus, here the "Single-Gripper Patent."

4. U.S. Pat. No. 2,521,311, issued Sept. 5, 1950 to Edward J. Schwoegler et al., entitled Corrosion Inhibiting Compositions, here the "First Anti-Corrosion Patent."

5. U.S. Pat. No. 2,534,201, issued Dec. 17, 1950 to Clemens A. Hutter, entitled Carton Having Metal Corrosion Inhibiting Characteristics, here the "Second Anti-Corrosion Patent."

6. Ser. No. 901,997, filed concurrently by Bernard Lerner, entitled Method of Making a Container Strip Having Inserts abandoned in favor of continuation application Ser. No. 151,320 filed May 19, 1980 now U.S. Pat. No. 4,337,058 issued June 19, 1982.

BACKGROUND OF THE INVENTION

1. Field of the Invention

The present invention relates to container strips comprised of flexible sheet or film material and, more particularly, to such containers formed with inserted elements or materials which have an effect on contents which may be disposed in a container and/or enhance the container in some way.

2. Description of the Prior Art

A concern in the packaging industry relates to operating on package contents to achieve some desired end while the contents are sealed in a container. For example, ferrous or aluminum products may be packaged in an airtight container and yet, after a long shelf life, the products can corrode or oxidize because of the harmful effects of the atmosphere or contaminants trapped within the container. Expensive and time-consuming solutions include hermetically sealing the products inside the container under a vacuum, or coating the products with an oxidation-resistant coating.

Similar problems arise with products susceptible to attack by moths or other pests, food which is subject to deterioration by bacterial action, and products which must be maintained within a predetermined temperature range. Other examples include products which should have a particular odor or products which are susceptible to mold. Other examples can be listed but the overall problem is the same: to provide a packaging technique in which contents sealed within a container may be acted on in a desirable manner but in which production speed is not impeded or packaging expense is not increased greatly.

Approaches which are known include placing a particular reactant, indicator, etc., inside the container along with the products being packaged. For example, it is known to provide garment storage bags in which a fumigant is included as part of either the container sidewall or a carrying frame. One garment bag employs a foraminous pocket mounted within the container for holding a supply of moth repellent or insecticide. Another garment bag employs a plurality of small bags containing fumigant which are attached to a board-like strip which in turn is affixed to a carrying frame within the container. It is apparent that these approaches are not effective for high-speed production, rough handling, or any number of other demands imposed upon modern containers.

It also is known to provide a plurality of frangible ampules containing color-sensitive chemicals mounted to a card, and then to place the card inside a container along with products which are to be sterilized. After the container has been sterilized and sealed, the ampules can be broken and the resulting color change (or lack of color change) will indicate whether the contents have been sterilized. This approach does not lend itself well to high-speed production because a separate inserting operation is required for the card to which the ampules are mounted.

Another concern in the packaging industry relates to displaying products for public consumption in such a manner that the products are displayed favorably. A common technique is to seal the products within a transparent container and either (a) include an advertising insert in the container to identify the container contents, manufacturer, and so forth, or (b) attach a piece of advertising material to the outside of the container. In many instances, the containers will be suspended from display racks and, in this case, the latter approach is desired because the externally disposed advertising material helps to support the container from the display rack as well as perform an advertising function.

Although containers can be suspended from display racks simply by punching a hole through the container, this approach generally is undesirable if the advertising material is disposed within the container. This is because inadequate container support may be provided, especially if the container contents are heavy and the container is not very strong. Also, problems arise if it is desired to maintain a particular atmosphere within the container, that is, if a seal must be maintained for some reason.

One workable approach has been able to divide the container into separate sections—one section for the container contents and one section identified as a so-called header which can be punctured or to which external advertising material can be affixed. This construction permits the container contents to be isolated at all times and yet the header portion of the bag is stiff enough to permit the container to be suspended from a display rack.

Although the foregoing approach generally is effective, several improvements still are possible. For example, the external advertising material must be stapled or glued to the outside of the header and this presents problems vis-a-vis production speed and the security of the attachment. Among other things, stress concentrations can be developed if the attachment is not secure enough and the container may be ruined during handling or loading onto the display rack. Also, the external advertising material tends to increase the bulk of the finished container so that handling difficulties are increased and more space is required to display a given quantity of containers than otherwise is desired.

SUMMARY OF THE INVENTION

The present invention provides a new and improved container strip formed from film or sheet material with inserted elements or material attached to the strip in such a way that the speed and efficiency of packaging products in the strip is unimpaired and the finished package is enhanced.

In a preferred form of the invention the new container strip is made up of a succession of detachable container portions and is formed from first and second film-like plastic web sections attached at their edges. One web section defines loading openings spaced along the strip with one opening defined in each container portion and a region of weakness adjacent each loading opening enables detachment of container portions from the strip. Inserted elements or materials are disposed between the web sections and attached to one web section. Individually inserted elements or materials are also disposed at predetermined positions relative to respective loading openings so that each container portion of the strip has an insert associated with it.

In one preferred embodiment of the invention, the insert is disposed within the product receiving volume of the container portion and the insert has an effect on contents which may be disposed within the product receiving volume.

An important feature of the invention enables the inserts to be substantially hidded from view when the completed package is displayed. The container is comprised of a transparent film-like material having an opaque portion suitably formed by, for example, printing. The insert is positioned in registry with the opaque portion so that the insert is shielded from view and does not detract from the appearance of the container or interfere with the visibility of the product in the package.

In another preferred embodiment of the invention, the inserted element or material forms part of a header which stiffens the container for display purposes. The container comprises a bag-like portion, or product receiving volume, and the header portion is attached to the bag-like portion. The header portion comprises the first and second webs of container material and an insert disposed between them and fixed in place to the header portion. For example the webs can be sealed together at least partly around the insert to retain it in place. The insert can be comprised of the same material as the webs. If the insert is at least as large as the header portion, then a heat-sealing and trimming operation affecting the webs will bond the insert and the webs to each other and assure stiffness of the header portion.

If additional stiffness is required, the insert can be adhered to the first or second web, or both. An especially favorable technique for doing this comprises applying adhesive to both webs at spaced intervals, preferably in a plurality of narrow strips extending longitudinally of the container. By this construction, external advertising material is no longer needed to stiffen the header and adequate stiffness is obtained with considerable decrease in bulk of the finished container.

Additional advantageous features of the invention will become apparent from the following detailed description of a preferred embodiment of the invention made with reference to the accompanying drawings which form a part of the specification.

DESCRIPTION OF THE PREFERRED EMBODIMENT

Figure 1:
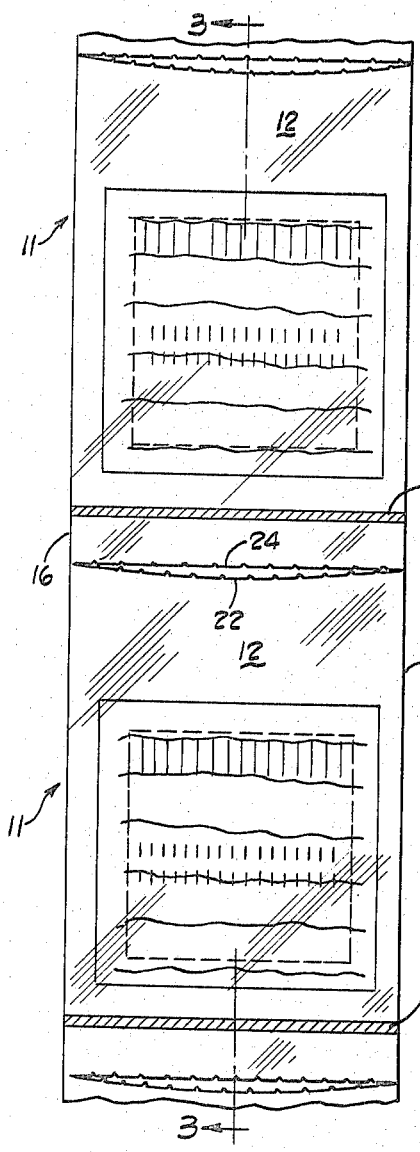
FIG. 1 illustrates interconnected containers according to the invention in which an insert is in registry with an opaque portion.

A container strip 10 according to the invention is shown in FIG. 1. The container strip 10 includes a plurality of identical, interconnected containers 11 which are formed from a flexible, heat-sealable sheet material such as polyethylene, or polypropylene. It is expected that a packager will employ a roll of the containers or a box of the containers stacked in zig-zag fashion so that the containers may be advanced one by one to a loading station where they may be opened, loaded, closed, and sealed. Thereafter, the containers may be collected and shipped wherever desired.

The Airbox patent and the Single-Gripper patent illustrate a strip of the containers and disclose different uses to which the containers may be put. These containers have been manufactured and sold by Automated Packaging Systems, Inc. under the registered trademark AUTOBAG.

The container strip 10 is formed by a first, overlying ply 12 and a second, underlying ply 14. The plies 12, 14 are joined together along sides 16, 18 so that a tube-like structure is created. It will be appreciated that the container strip 10 may be formed by various techniques as taught by the Airbox patent and the Container patent. For example, the strip may be extruded in seamless form or the strip may be formed by sealing or bonding together the side edges of two elongated, superimposed plies, as mentioned above. Alternatively, a flat sheet may be folded once upon itself and the two unbonded edges bonded together to form only one bonded side portion.

In order to form the individual containers 11 as part of the strip, a plurality of spaced, heat-sealed portions 20 are formed along the strip at regular intervals. The seals 20 extend transversely of the strip and completely across the strip to include the sides 16, 18.

In order to complete the containers, perforated lines 22, 24 extend completely across plies 12, 14, respectively, and provide a line of weakness in the container strip for separation of the containers. The perforated portion 22 may be separated to form a container opening, while the perforated portion 24 may be left intact. As described more completely in the Airbox patent, the Container patent, and the Single-Gripper patent, the container strip 10 may be fed longitudinally with the containers oriented to be fed closed end first so that an appropriately directed airblast may inflate each container. By this technique, articles may be inserted into the inflated container and thereafter the container may be severed from the succeeding container along the perforated line 24; the container then may be closed and heat-sealed. In the Single-Gripper patent, the step of closing, severing, and sealing are done substantially simultaneously so that a great increase in production speed is possible.

Each container 11 includes a sheet-like insert 26 which forms part of an inner surface of a product-containing volume of the container. The insert 26 is adhered to one of the container plies 12, 14 along that portion of the insert disposed closest to the perforated lines 22, 24 by a drop of hot melt glue 28. The container may be passed between nip rolls so that the plies 12, 14 and the insert 26 may be compressed to firmly adhere the insert to one of the plies. Accordingly, when the container is inflated by an airblast or otherwise, the insert 26 will be held closely to the ply to which it is adhered and the insert will not interfere with any product being loaded into the container. Also, and perhaps more fundamentally, the insert cannot be blow out of the container by the airblast that inflates the container.

Advertising for the container contents may be provided by an opaque portion 30 included as part of one of the plies 12, 14. As shown in FIG. 1, the opaque portion includes indicia describing the container contents, the manufacturer, and so forth. In order to enhance the appearance of the container, the insert 26 is slightly smaller than the opaque portion and is positioned within the container in registry with the opaque portion so that the insert is not visible from the front.

Because the containers 11 are constructed of a material such as polyethylene, or polypropylene, it is expected that the container will be inert with respect to products which may be disposed within the container. The insert, on the other hand, by design will contain constituents which have an effect on contents which may be disposed within the container. Each insert, for example, may comprise a kraft paper swatch impregnated with materials which inhibit corrosion in ferrous and aluminum parts. After each container 11 has been sealed, the atmosphere within the container is captive and the corrosion inhibitors can work effectively to obviate corrosion or oxidation on such ferrous or aluminum products as fasteners, nails, springs, bearings, and so forth. The Anti-Corrosion patents describe vaporizable, corrosion-inhibiting compositions and techniques by which the composition may be employed with porous structures such as cardboard or chipboard.

The inserts also can be impregnated with other constituents to affect container contents as desired or to indicate the status of container contents or the container atmosphere. For example, the inserts may include an anti-static material, an odor-influencing material such as perfume, a temperature-sensitive material which changes color when a predetermined temperature is reached, a microbe-sensitive material which changes color when sterilization is effected, or an anti-mold material. In all cases, the insert includes a material having active properties with respect to container contents so as to influence the contents or indicate their status.

Because the inserts can be inserted into the containers and adhered in place by generally conventional container-making machinery (see the referenced co-pending application), fabrication time of the containers is not affected adversely. The thickness of the resultant container is not materially changed and, because the inserts are held securely in place within the container, product loading times are not affected detrimentally. In short, the containers 11 according to the invention can eliminate custom wrapping, coating, spraying, or dipping, plus the time and expense of placing impregnated inserts into the containers by hand.

Figure 2:
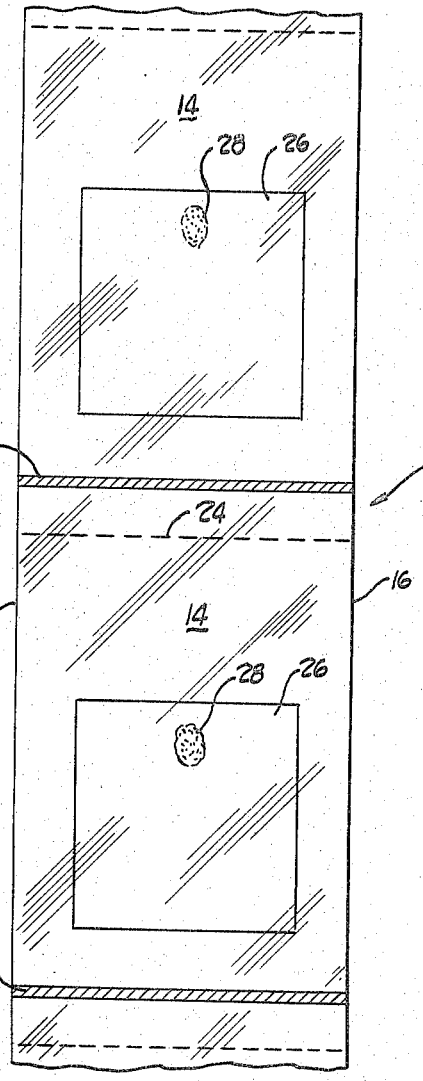
FIG. 2 illustrates the reverse side of the container strip of FIG. 1, and shows the attachment between the container and the insert.
Figure 3:
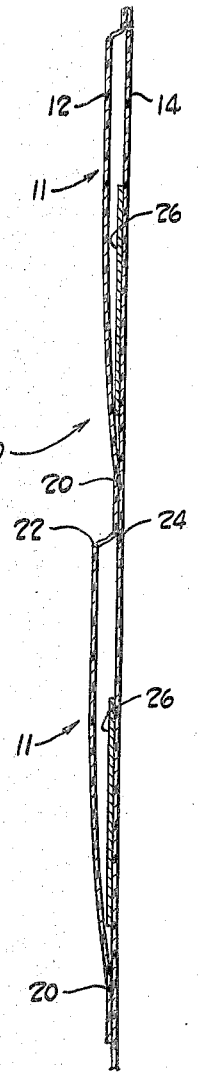
FIG. 3 is a cross-sectional view taken along line 3—3 of FIG. 1.
Figure 4:
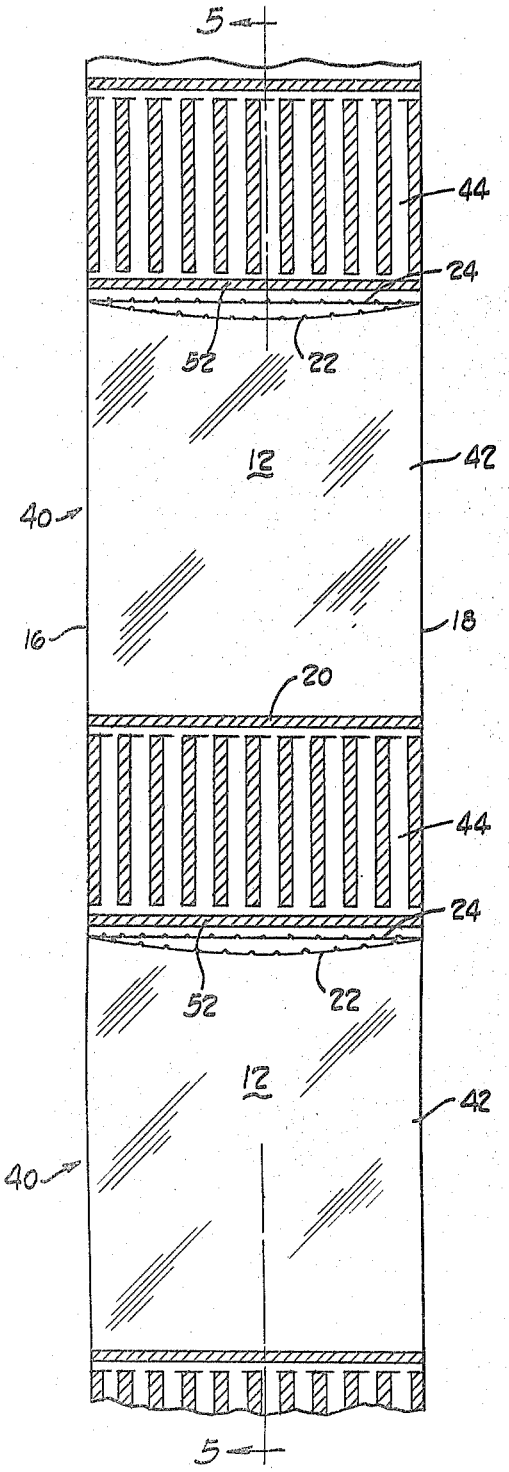
FIG. 4 is a view similar to FIG. 1 showing a chain of interconnected containers having a header according to the invention.
Figure 5:
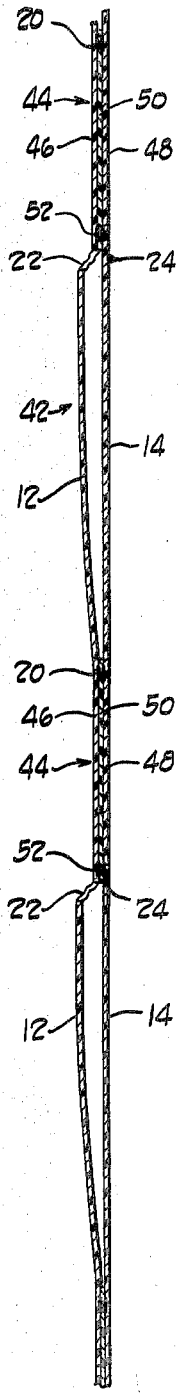
FIG. 5 is a cross-sectional view taken along line 5—5 of FIG. 4.

Another embodiment of the invention is shown in FIGS. 4 and 5. This embodiment is similar to the container shown in FIGS. 5 and 6 of the Container patent. Reference numerals from the foregoing embodiment of FIGS. 1–3 are carried over where appropriate.

Again, a container strip is provided, which container strip includes a plurality of substantially identical containers 40. Each container 40 includes a bag-like portion 42 and a header portion 44. The bag-like portion 42 is constructed substantially identically to the containers 11, except that use of the insert depicted there is optional with the bag-like portion 42.

The header 44 is disposed intermediate the heat seal 20 of one container and the perforated portions 22, 24 of the succeeding container. Referring more particularly to FIG. 5, the header 44 includes a first web 46, a second web 48, and an insert 50 disposed intermediate the first and second webs 46, 48. The web 46 is an extension of the upper ply 12 included as part of the bag-like portion 42. The second web 48 is an extension of the other ply 14, also employed to form the bag-like portion 42.

In order to retain the insert 50 firmly in place, a heat seal 52 is provided adjacent the perforated portions 22, 24, and extends completely across the width the container between and including the sides 16, 18. In this manner the insert 50 is secured in place as part of the header 44 and cannot be removed from the header 44. It has been found that if the insert 50 initially is as wide or wider than the first and second webs 46, 48, and is trimmed and heat-sealed along with the same operations being performed on the webs 46, 48, then the stiffness of the header is increased. It also has been found that the stiffness of the header 44 is increased remarkably by adhering the insert 50 to either or both of the webs 46, 48. A particularly effective technique is to coat both webs with a cement located at spaced intervals, especially in a plurality of narrow strips extending longitudinally of the container. This construction is illustrated in FIGS. 4 and 5.

The container 40 completely obviates the need for header stiffeners such as advertising material previously applied externally of the header. Either of the webs 46, 48 may include opaque portions having indicia to serve an advertising or identifying function, and openings may be provided in the header (as shown in FIG. 5 of the Container Patent) to permit the container to be suspended from a display rack without affecting the atmosphere trapped within the bag-like portion 42. If desired, the insert 26 (FIGS. 1–3) may be employed as part of the bag-like portion 42 so that the optimum benefits of the invention can be achieved in a single container.

It will be appreciated that a container constructed according to the invention may be manufactured exceedingly rapidly, with little or no affect on production speeds from that known with prior container manufacture. A container according to the invention can be used with conventional packaging machinery with no adverse impact on inflating the containers or loading them with various products. Because the inserts are disposed internally, the containers can be handled rapidly with little fear that damage to the containers or the inserts will result.

Although the invention has been described with a certain degree of particularity, it will be appreciated that the present disclosure of the preferred embodiment has been made only by way of example. Various changes in the details of construction may be resorted to without departing from the true spirit and scope of the invention and it is intended to cover all such changes in the appended claims.

I claim:

1. An article for use in packaging products comprising:

(a) an elongated tubular web of plastic having a pair of plies:

(b) the web including a series of spaced, transverse seals securing the plies together to delineate a plurality of containers connected together end to end;

(c) the web also including a plurality of spaced lines of weakness with each container having at least one such line of weakness to permit facile separation of each container from the web;

(d) each of the containers including an opening such that the interconnected containers comprise a chain of coilable open bags;

(e) a plurality of flexible inserts each adhered to at least one associated ply and each within a different one of the containers; and, (f) each of the inserts having a portion secured to its associated ply near an end of the insert which is the insert end nearest the bag opening of the connected bag container and another portion not secured to either ply whereby opening of a container and loading of a product therein will not be interfered with by the insert nor will the integrity of the insert to ply adherence be jeopardized by such opening and loading.

2. The article of claim 1 wherein there is at least one insert in each container.

3. The article of claim 1 wherein the web is formed from substantially transparent plastic film material, one ply includes an opaque portion and said insert element is adhered in substantial alignment with the opaque portion.

4. The article in claim 1 wherein each opening is formed in a first web ply and the insert is adhered to a second web ply.

5. The article of claim 1 wherein each insert is comprised of a corrosion-inhibiting material.

6. The article of claim 1 wherein each insert is comprised of an anti-static material.

* * * * *